United States Patent [19]

Caimi

[11] Patent Number: 4,644,690

[45] Date of Patent: Feb. 24, 1987

[54] SLIDING DOOR STRUCTURE

[76] Inventor: Giuseppe Caimi, Via Provinciale, 31, 22060 Novedrate, Italy

[21] Appl. No.: 777,245

[22] Filed: Sep. 18, 1985

[30] Foreign Application Priority Data

Mar. 25, 1985 [IT] Italy ..... 20062 A/85

[51] Int. Cl.[4] ..... E05D 15/20

[52] U.S. Cl. ..... 49/130; 49/128; 49/209

[58] Field of Search ..... 49/127, 128, 129, 130, 49/209

[56] References Cited

U.S. PATENT DOCUMENTS 990,537 4/1911 Friend et al. ..... 49/128

2,680,268 6/1954 Rutherford ..... 49/130

2,893,071 7/1959 Oden ..... 49/130

*Primary Examiner*—Kenneth J. Dorner

*Assistant Examiner*—Gerald A. Anderson

*Attorney, Agent, or Firm*—Bucknam and Archer

[57] ABSTRACT

A sliding door structure suitable for furniture and the like, comprises a first door (1) and a second door (2), respectively slidable on a pair of parallel, spaced upper guides (4,6) and a pair of parallel, spaced lower guides (3,5). The said first door (1) is connected to rollers (17), which roll on the guides (4), by a mechanism (10–40) able to cause a coplanar positioning of the doors (1,2) in the closure position, and displacement of the first door (1), substantially perpendicularly with respect to the door translation direction, to superimpose the first door (1) over the second door (2) during opening of the doors themselves.

9 Claims, 6 Drawing Figures

SLIDING DOOR STRUCTURE

The present invention relates generally to a sliding door structure and particularly to a sliding door structure suitable for furniture and the like.

Many items of furniture currently available on the market have a front closure in the form of doors slidable along guides which extend parallel to one another. In the known sliding door structures there are generally provided two parallel, adjacent lower guides and two parallel adjacent upper guides which are closely spaced from one another and constitute guide tracks for respective first and second doors which are, consequently, movable along paths of displacement which are parallel to but spaced from one another. This known sliding door structure is widely used and has been found to be very practical, but it has the disadvantage that in the closure position the doors lie in planes which are offset from one another which results in a step at the adjacent edges: consequently it is not possible to have smooth continuity of the front surface of the furniture, and this leads to an assymmetry which is aesthetically unsatisfactory.

Arrangements which allow the sliding doors to be coplanar in the closure position have been sought, but the structures so far devised have been exceedingly complex and in general are prone to jamming, which reduces the practicality and reliability of the doors.

The present invention seeks to eliminate the above mentioned disadvantages by providing a sliding door structure suitable for furniture and the like which will allow the possibility of having two or more sliding doors for closing the front face of an item of furniture, which doors can be disposed in a coplanar position with respect to one another in the closure position in such a way as to provide surface continuity over the front face of the furniture.

According to the present invention there is provided a sliding door structure comprising at least a first door and a second door, respectively slidable on a pair of upper guides and a pair of lower guides which are parallel to and spaced from one another, characterised by the fact that the said first door is connected to rollers movable on the guides, with the interposition of a linking mechanism which positions the said first door substantially coplanar with the second door in the closure position and allows displacement of the first door transversely with respect to the direction of translation of the doors during their opening or closing movement to superimpose the first door over the second door when the doors are open.

The present invention thus offers the advantage of a sliding door structure for furniture and the like which permits the doors to be coplanar with one another in the closure position and for this coplanar position to be reached in an automatic manner without the need for complex mechanisms.

Another advantage of the present invention is that it provides a sliding door structure in which the relative movement between the doors, from the coplanar position to the position where the planes in which they lie are offset from one another, takes place simply by the interference of the doors with one another without having to require any particular actuation on the part of the user. The full movement thus takes place with only a simple opening or closing motion by the user.

Not the least advantage of the present is that it is capable of providing a sliding door structure for furniture and the like which is of rapid and simple assembly and which, moreover, is not subjected to jamming or damage of any type.

One embodiment of the present invention will now be more particularly described, by way of example with reference to the attached drawings, in which.

Figure 1:
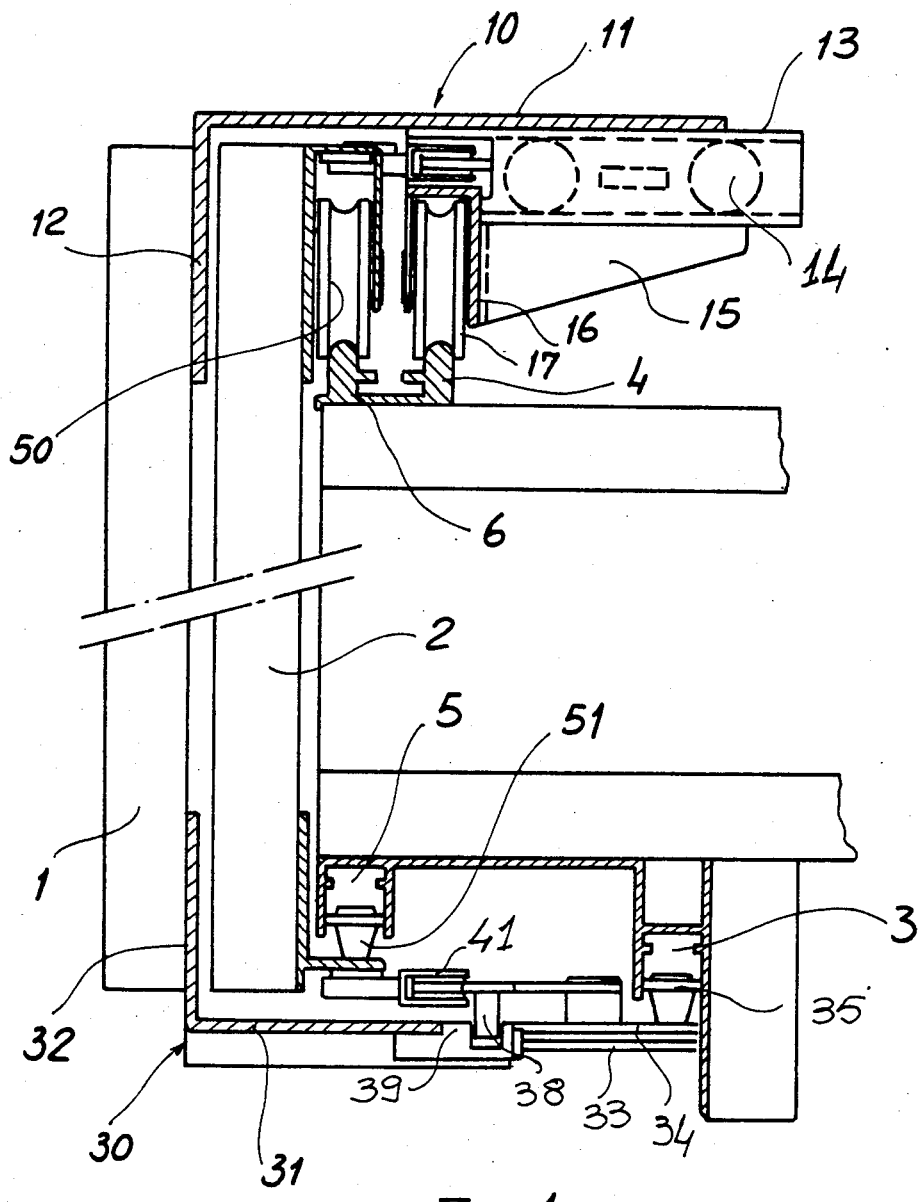
FIG. 1 is a schematic vertical section of a sliding door structure made according to the principles of the present invention.

Referring now to the drawings, the sliding door structure for furniture and the like comprises at least one first door indicated 1, and at least one second door indicated 2, which are advantageously constituted by a flat panel of wood or other suitable material.

The first door 1 is connected, by means of a mechanism which will be described in more detail below, to a first lower fixed guide 3 and to a first upper fixed guide 4, whilst the second door 2 is connected, in a conventional manner, to a second lower fixed guide 5 and a second upper fixed guide 6. The lower fixed guides, as well as the upper fixed guides, all extend parallel to one another and are mutually spaced.

Figure 2:
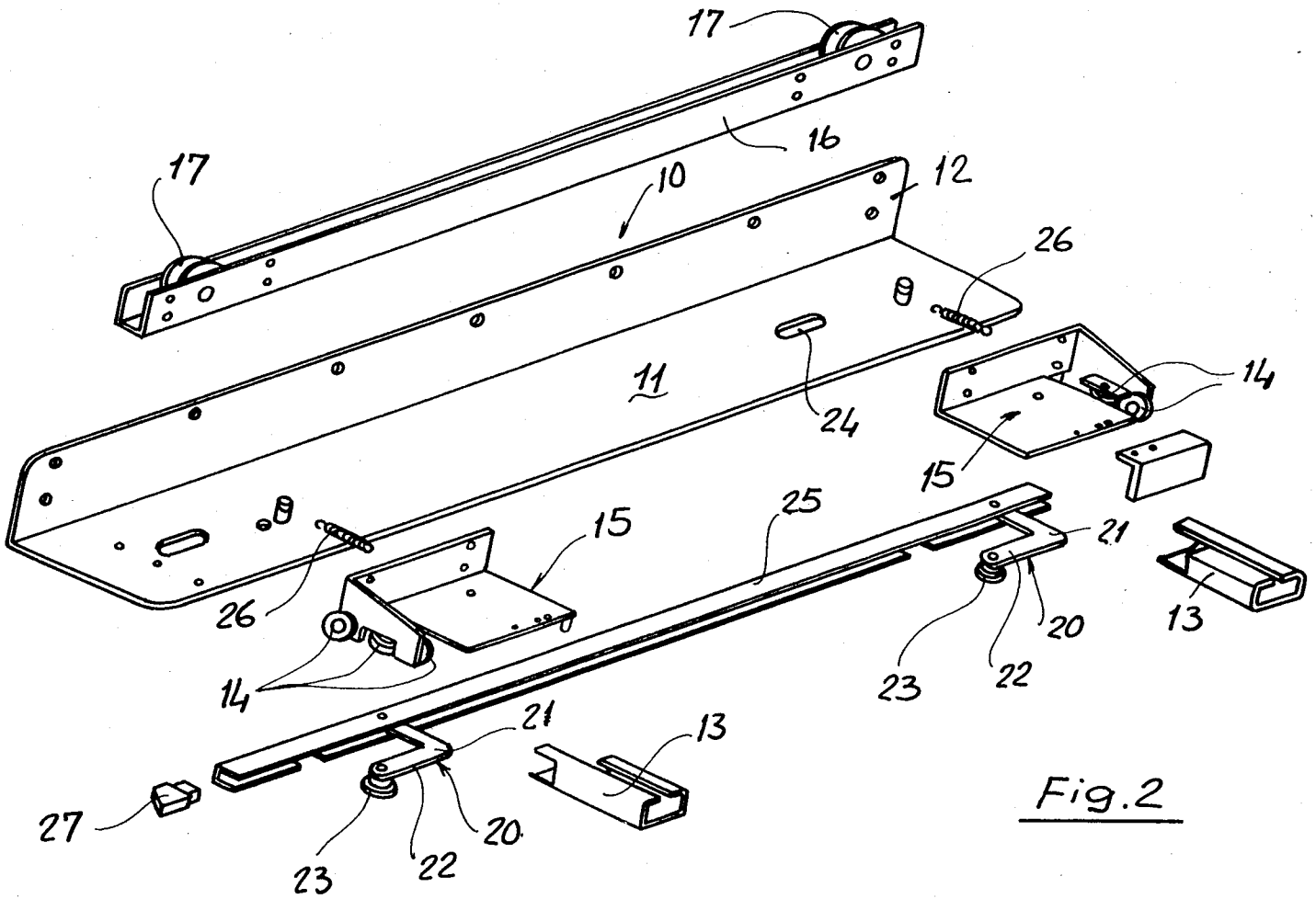
FIG. 2 is an exploded perspective view from below of a part of the mechanism connected to the upper part of the first door.

The first door is connected indirectly to the guides 3 and 4 by a linking mechanism which is able to allow the door 1 to be displaced in a direction perpendicular to the translation direction along which the door moves during opening, thus making it possible for the first and second doors to move past each other upon opening whilst it is possible to dispose the doors, automatically, coplanar with one another in the closure position. This linking mechanism has an upper part which is shown in exploded bottom perspective view in FIG. 2, which includes a support bracket 10 having a horizontal flange 11 from which extends a substantially downwardly projecting vertical flange 12 which is connected to the upper edge of the first door 1. Rigidly connected adjacent each end of the flange 11 is a respective guide sleeve 13 into each of which engages a respective set of rollers 14 some of which have a horizontal axis and some of which have a vertical axis. The sets of rollers 14 are supported by respective brackets 15 which are both rigidly connected to a channel section element 16 which rotatably supports the upper rollers 17 on the first guide 4.

To effect lateral displacement of the bracket 10 with respect to the rollers 17 there are provided cranked thrust arms generally indicated at 20 which are each pivoted at their central or elbow portion 21 to a respective bracket 15 and which, at the end of a first limb 22 have an engagement roller 23 which is housed in a respective elongate slit 24 in the horizontal flange 11 of the support bracket 10. The other limb of each cranked thrust arm 20 is connected to an upper thrust arm displacement rod 25, which joins the thrust arms 20 together and synchronizes their movement. There are also provided resilient biasing means which act between the support bracket 10 and the bracket 15 and which are advantageously constituted by tension springs 26 which resiliently bias the door 1 towards a position coplanar with the door 2 as will be made more clear hereinbelow.

At one end of the upper thrust arm displacement rod 25 there is provided a ramp insert indicated at 27, which is force fitted into the end of the rod 25 itself.

Figure 3:
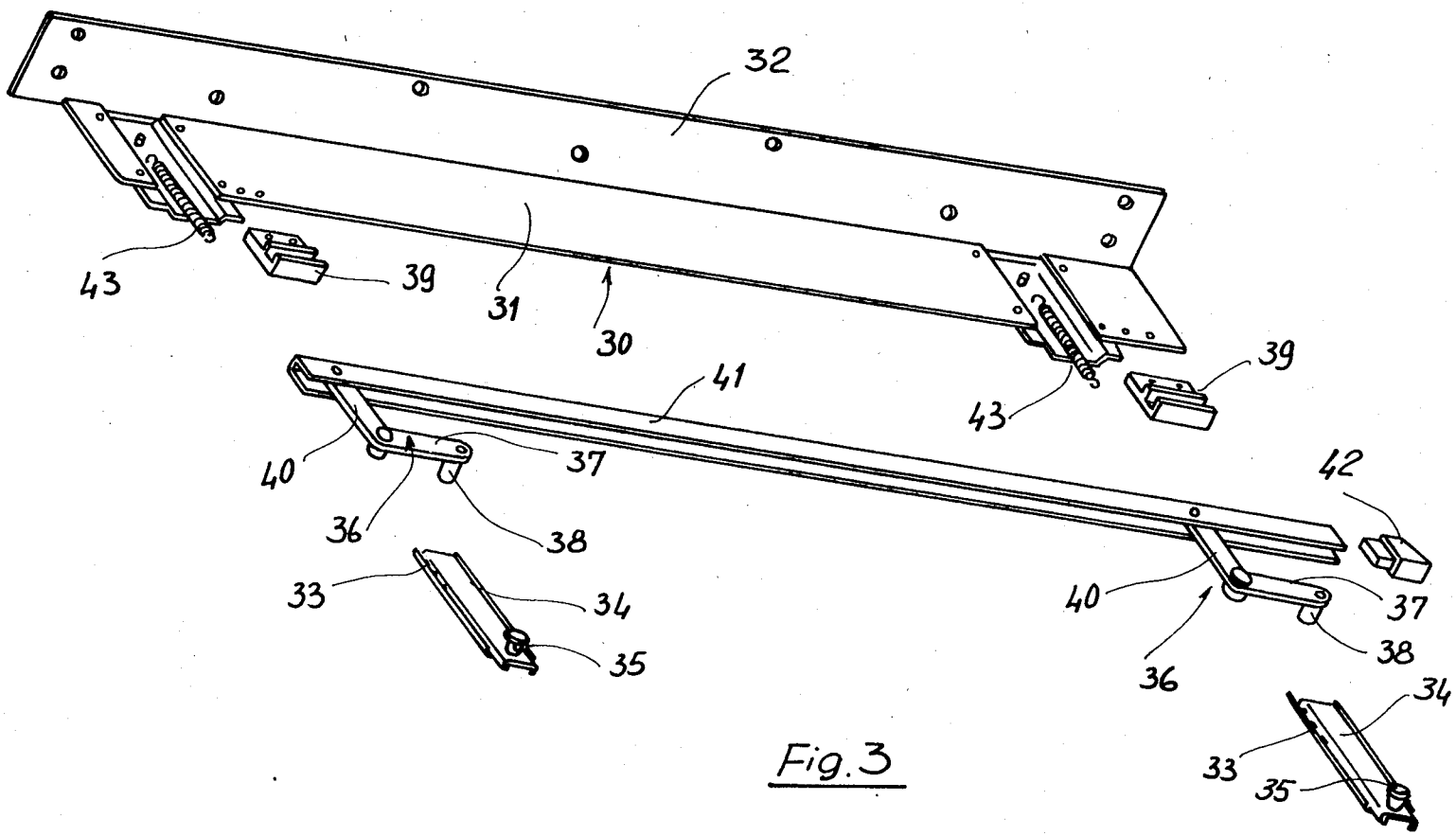
FIG. 3 is an exploded perspective view, of part of the mechanism connected to the lower part of the first door.
Figure 4:
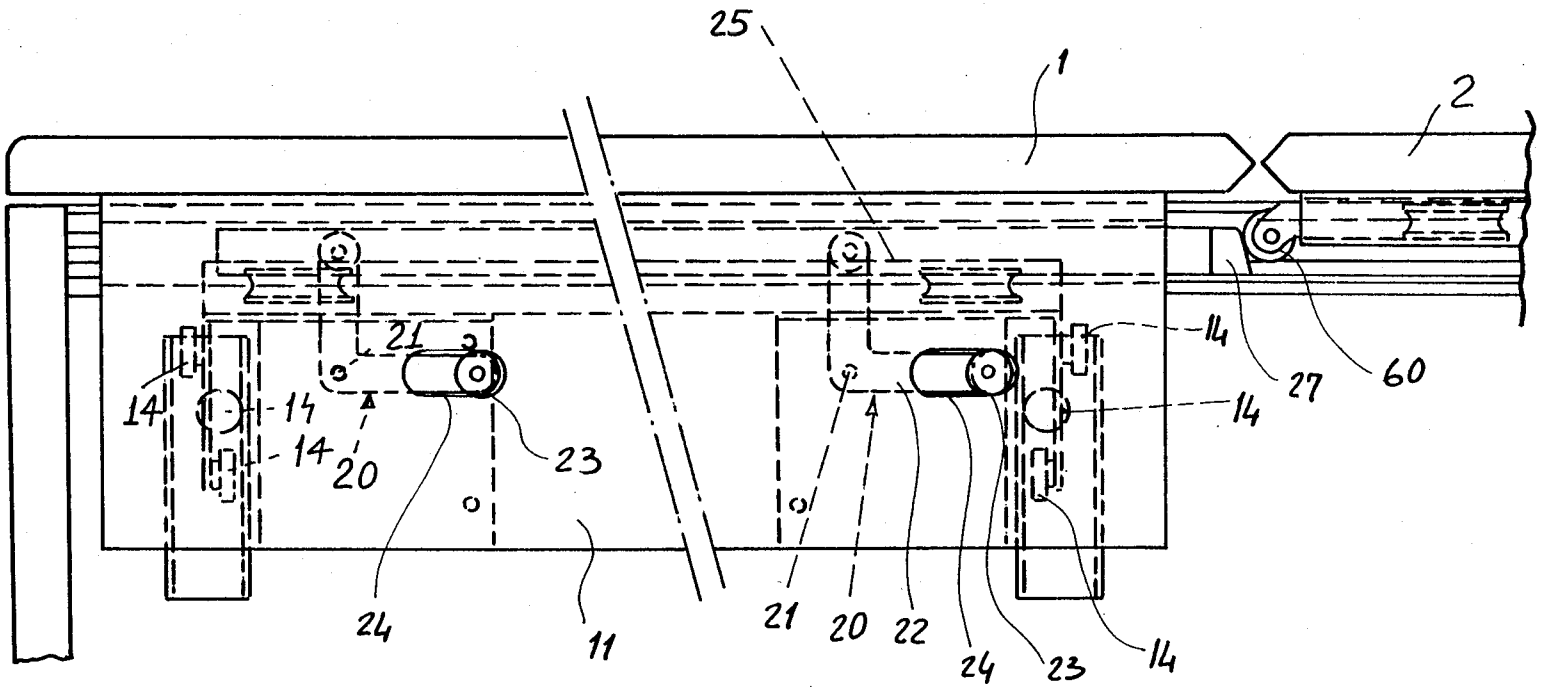
FIG. 4 is a plan view of the upper part of the two doors in the closure position.
Figure 5:
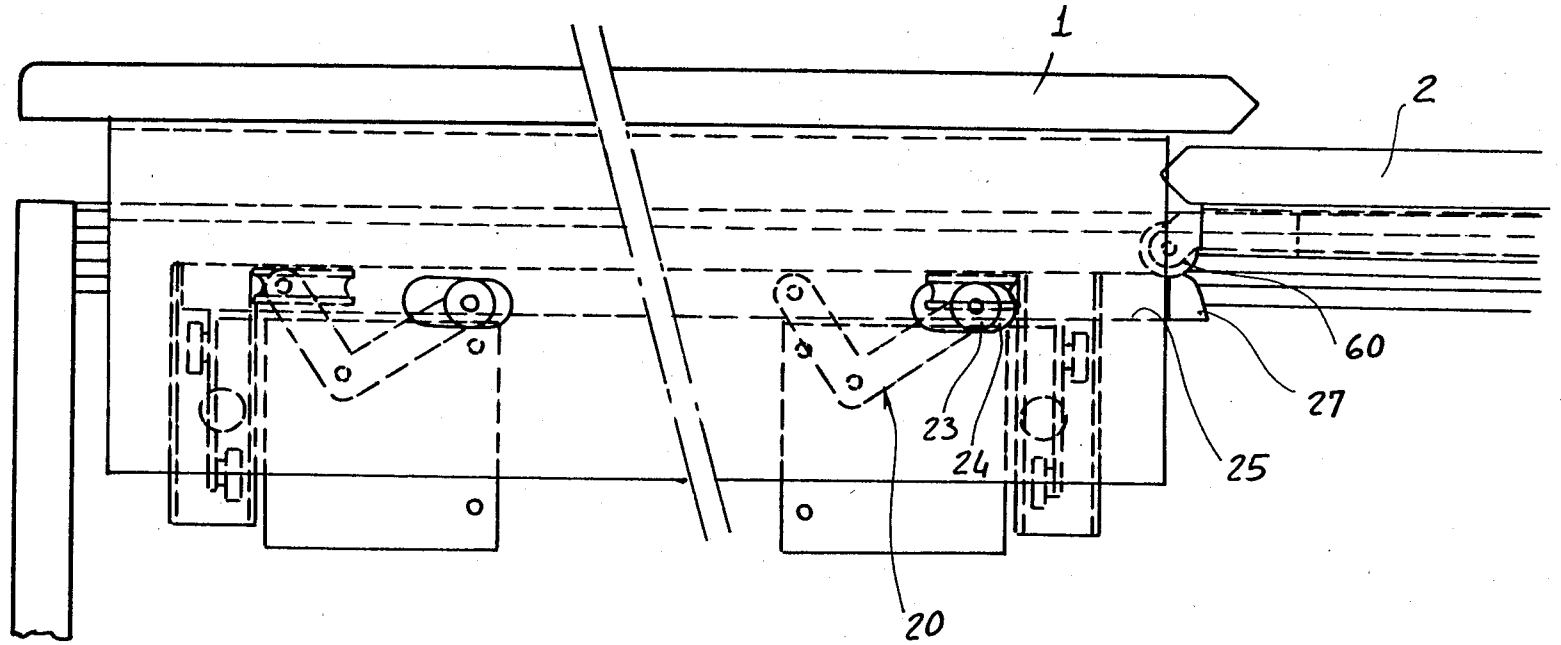
FIG. 5 is a plan view of the upper part of the two doors in a partly open position.
Figure 6:
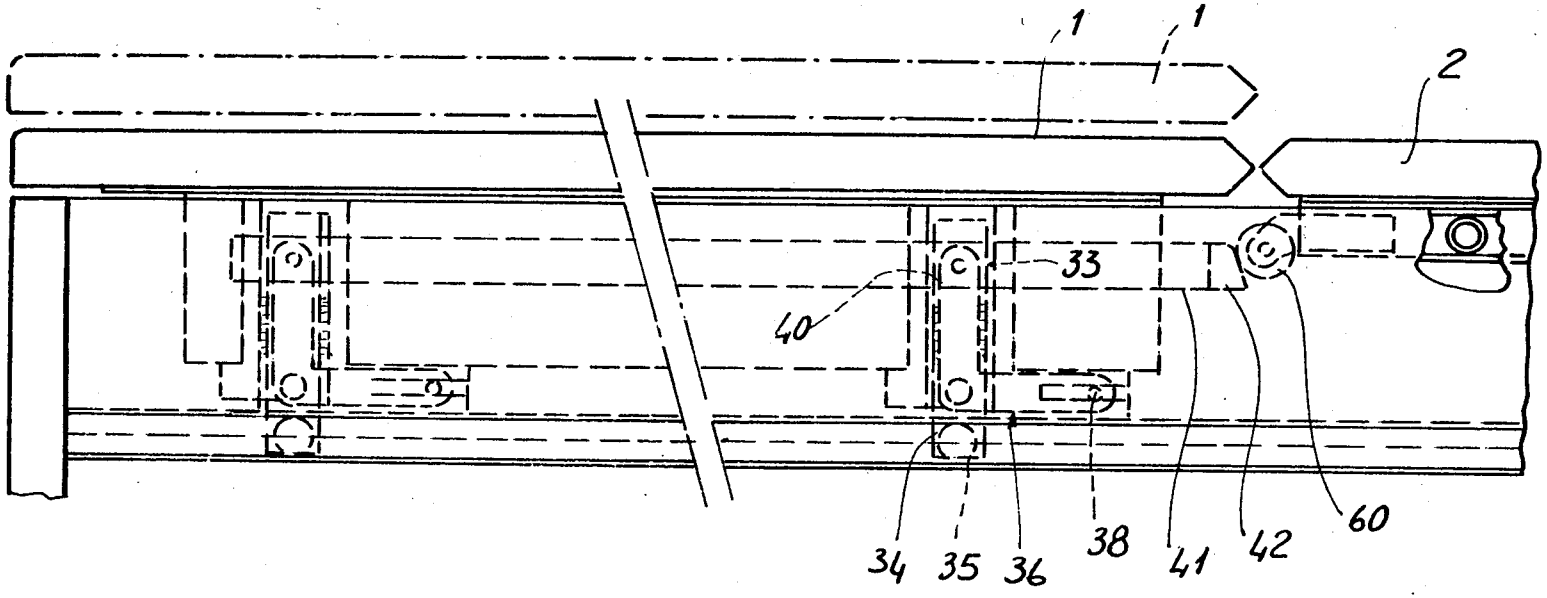
FIG. 6 is a plan view showing the lower part of the doors, with the doors shown in the closure position in continuous outline and in the open position in broken outline.

At the lower edge of the first door 1 it is connected to a lower support bracket 30, shown in FIG. 3, which has a horizontal flange 31 from which extends upwardly a vertical flange 32 which is fixed to the lower edge of the door 1 itself. The horizontal flange 31 is fixed at each end to respective slides 33 each of which slidably couples with a respective movable guide 34 each supporting a roller 35 having a vertical axis, which slidably engages in the first fixed guide 3 (FIG. 1). The elbow portion of a respective cranked lower thrust arm 36 is pivoted to each movable guide 34. Each cranked thrust arm 36 has a first limb 37, which terminates in a pin 38 slidably connectable in a channel element 39 rigidly connected to the bracket 30, and a second limb 40 by which the lower thrust arm 36 is pivoted to a lower thrust arm displacement rod 41 which is also provided at one end with a lower ramp insert 42.

The second door 2 is provided at its upper edge with upper guide rollers 50, which roll on the second upper guide 6 and, at its lower edge, with lower rollers 51, which engage with the second of the lower fixed guides 5. Connected to the second door, at a lateral edge of the door itself, there are provided thrust rollers indicated 60, which have the function of engaging with the upper and lower thrust arm displacement rods 25 and 41 in such a way that, during opening translation of one or the other door along the door slide track, there is created a thrust which overcomes both the bias of the springs 26 provided in the upper connecting mechanism, and the bias of the springs 43 provided in the lower connecting mechanism, which causes a displacement of both the lower and upper thrust arms about their central or elbow pivots. This causes displacement of both the upper bracket 10 and the lower bracket 30 substantially perpendicular to the translation direction of the doors, with consequent relative displacement of the planes in which the first and the second doors lie. In these conditions the first door is in practice offset with respect to the second door and can slide past it without interference.

In the closure position contact between the thrust rollers and the displacement rods ceases and the springs 26 and 43 resiliently bias the first door returning it to a position coplanar with the second door. The movements described hereinabove take place in an entirely automatic manner and solely because of the relative translation movement of the first and second doors which causes the thrust rollers supported by the second door to interfere with the displacement rods which connect together the thrust arms thereby causing rotation about the central pivots with consequent lateral displacement of the lower and upper brackets which support the first door.

I claim:

1. A sliding door structure comprising at least a first and a second upper guide and a first and a second lower guide, said guides being elongated and parallel to and spaced from one another; at least a first and a second door each extending along a plane and having an upper and a lower edge region; means for supporting said first and second doors respectively on said first and second upper guides for sliding movement longitudinally thereof and parallel to said planes, and said first door also for transverse displacement relative to said planes, between a closed position in which said first door is substantially coplanar with said second door and a plurality of open positions in which said first door is superimposed with said second door, including first and second upper rollers respectively engaging said first and second upper guides for said movement along the same, and means for rotatably mounting said first and second upper rollers on said upper edge regions respectively of said first and second door, including an upper linking mechanism which mounts said first upper rollers on said upper edge region of said first door for said transverse displacement of said first door relative to said first upper rollers at said closed position; and means for guiding said lower edge regions of said first and second doors respectively on said first and second lower guides for said movement longitudinally thereof and for said transverse displacement of said first door at said closed position, including first and second lower rollers respectively engaging said first and second lower guides for said movement along the same, and means for rotatably mounting said first and second lower rollers on said lower edge regions respectively of said first and second door, including a lower linking mechanism which mounts said first lower rollers on said lower edge region of said first door for said transverse displacement of said first door relative to said first lower rollers at said closed position and includes an elongated lower bracket having an upright flange affixed to said lower edge region of said first door and a substantially horizontal flange, at least two slides secured to said horizontal flange at locations which are spaced from one another longitudinally of said lower bracket, at least two guiding members each engaging one of said slides and carrying one of said first lower rollers, at least two cranked lower thrust elements each having an elbow portion pivoted on one of said guiding members and two arms one of which is slidably connected to said horizontal flange of said lower bracket, a lower thrust element displacement rod pivotally connected to the other of said two arms of each of said lower thrust elements, and a thrust roller rotatably mounted on said second door and engaging said lower thrust element displacement rod.

2. The sliding door structure as defined in claim 1, and further comprising lower biasing means interposed between said horizontal flange of said lower bracket and each of said guiding members of said lower linking mechanism and operative for urging said first door transversely of said planes toward said closing position of said first door.

3. The sliding door structure as defined in claim 1, wherein said lower thrust element displacement rod includes a ramp insert at one end thereof which faces said thrust roller.

4. The sliding door structure as defined in claim 1, wherein said upper linking mechanism includes an elongated upper supporting bracket having an upright flange affixed to said upper edge region of said first door and a substantially horizontal flange provided with at least two slots, at least two sleeves secured to said horizontal flange at locations which are spaced from one another longitudinally of said upper supporting bracket, at least two connecting brackets, at least one supporting roller rotatably mounted on each of said connecting brackets and engaging one of said sleeves, at least two cranked upper thrust elements each having an elbow portion pivoted on one of said connecting brackets and two arms, an engaging roller rotatably mounted on one of said arms of each of said upper thrust elements and received in one of said slots of said horizontal flange of said upper supporting bracket, an upper thrust element displacement rod pivotally connected to the other of said two arms of each of said upper thrust elements, and a thrust roller rotatably mounted on said second door and engaging said upper thrust element displacement rod.

5. The sliding door structure as defined in claim 4, and further comprising upper biasing means interposed between said upper supporting bracket and each of said connecting brackets of said upper linking mechanism and operative for urging said first door transversely of said planes toward said closing position of said first door.

6. The sliding door structure as defined in claim 4, wherein said lower thrust element displacement rod includes a ramp insert at one end thereof which faces said thrust roller.

7. A sliding door structure comprising at least a first and a second upper guide and a first and a second lower guide, said guides being elongated and parallel to and spaced from one another; at least a first and a second door each extending along a plane and having an upper and a lower edge region; means for supporting said first and second doors respectively on said first and second upper guides for sliding movement longitudinally thereof and parallel to said planes, and said first door also for transverse displacement relative to said planes, between a closed position in which said first door is substantially coplanar with said second door and a plurality of open positions in which said first door is superimposed with said second door, including first and second upper rollers respectively engaging said first and second upper guides for said movement along the same, and means for rotatably mounting said first and second upper rollers on said upper edge regions respectively of said first and second door, including an upper linking mechanism which mounts said first upper rollers on said upper edge region of said first door for said transverse displacement of said first door relative to said first upper rollers at said closed position and includes an elongated upper supporting bracket having an upright flange affixed to said upper edge region of said first door and a substantially horizontal flange provided with at least two slots, at least two sleeves secured to said horizontal flange at locations which are spaced from one another longitudinally of said upper supporting bracket, at least two connecting brackets, at least one supporting roller rotatably mounted on each of said connecting brackets and engaging one of said sleeves, at least two cranked upper thrust elements each having an elbow portion pivoted on one of said connecting brackets and two arms, an engaging roller rotatably mounted on one of said arms of each of said upper thrust elements and received in one of said slots of said horizontal flange of said upper supporting bracket, an upper thrust element displacement rod pivotally connected to the other of said two arms of each of said upper thrust elements, and a thrust roller rotatably mounted on said second door and engaging said upper thrust element displacement rod; and means for guiding said lower edge regions of said first and second doors respectively on said first and second lower guides for said movement longitudinally thereof and for said transverse displacement of said first door at said closed position.

8. The sliding door structure as defined in claim 7, and further comprising upper biasing means interposed between said upper supporting bracket and each of said connecting brackets of said upper linking mechanism and operative for urging said first door transversely of said planes toward said closing position of said first door.

9. The sliding door structure as defined in claim 7, wherein said lower thrust element displacement rod includes a ramp insert at one end thereof which faces said thrust roller.

* * * * *